US005302931A

United States Patent [19]

Muz

[11] Patent Number: 5,302,931

[45] Date of Patent: Apr. 12, 1994

[54] COIL FOR A TRANSFORMER, IN PARTICULAR A HIGH-VOLTAGE TRANSFORMER

[75] Inventor: Edwin Muz, Reutlingen, Fed. Rep. of Germany

[73] Assignee: Haugh GmbH & Co. KG, Leinfelden-Echterdingen, Fed. Rep. of Germany

[21] Appl. No.: 776,419

[22] PCT Filed: May 18, 1990

[86] PCT No.: PCT/EP90/00806

§ 371 Date: Nov. 18, 1991

§ 102(e) Date: Nov. 18, 1991

[87] PCT Pub. No.: WO90/14673

PCT Pub. Date: Nov. 29, 1990

[30] Foreign Application Priority Data

May 26, 1989 [DE] Fed. Rep. of Germany ..... 3917212

[51] Int. Cl.[5] ..... H01F 15/02

[52] U.S. Cl. ..... 336/82; 29/605; 336/846; 336/107

[58] Field of Search ..... 336/82, 84 R, 84 C, 336/107; 29/602.1, 605

[56] References Cited

U.S. PATENT DOCUMENTS

| | | | |
|---|---|---|---|
| 2,775,742 | 3/1952 | Bogue et al. | 336/83 |
| 3,947,795 | 3/1976 | Donnelly et al. | 336/184 |
| 4,449,111 | 5/1984 | Nakajima | 336/206 |

*Primary Examiner*—Leo P. Picard
*Assistant Examiner*—Christopher Horgan
*Attorney, Agent, or Firm*—Shenier & O'Connor

[57] ABSTRACT

A method of manufacturing a coil for a transformer and in particular a high voltage transformer in which the starting end of a wire with a bondable thermoplastic sheet is electrically conductively connected to an axially slit sleeve of non-magnetic metal which sleeve is placed on a rotary winding tool to form an essentially cylindrical wire winding directly on the sleeve with the end faces of the sleeve extending beyond the winding. Heat is applied to the winding to bond the individual turns to each other. One end of the sleeve carrying the winding is placed on the bottom of a casting mold and the end of the wire remote from the starting end is connected to a terminal. A casting compound is introduced into the mold to anchor the connecting terminal. The outside of the casting compound is provided with an electrically conductive casing which is electrically connected to the sleeve.

1 Claim, 1 Drawing Sheet

COIL FOR A TRANSFORMER, IN PARTICULAR A HIGH-VOLTAGE TRANSFORMER

The invention relates to a method for manufacturing a coil for a transformer, in particular a high-voltage transformer.

A known transformer (US-A-2775742) comprises a sleeve slit axially throughout and a wire winding with a winding start and a winding end arranged thereon. The sleeve protrudes on both sides thereof over the wire winding, and an electrically insulating casting compound is cast around the outside of sleeve and wire winding such that the upper and lower rims of the sleeve are exposed. The body formed by the casting compound is firmly connected to a connecting terminal 11 connected to the winding end and is provided on the outside thereof with an electrically conductive casing. The electrically conductive casing is electrically conductively connected to the sleeve.

In the manufacture of this known coil, two slit sleeve parts are subsequently pushed with their end faces into a separate insulating coil body onto which the wire winding has previously been wound.

The object of the invention is to manufacture a coil of the given kind in a simpler way and using a smaller number of individual parts.

The object is accomplished in accordance with the invention by the characterizing features of the patent claim. Owing to the wire winding being directly wound onto the slit sleeve, a separate coil body can be dispensed with. The winding start is fixed and stabilized by the electrically conductive connection of the winding start with the sleeve. The slit sleeve is made of one part and is robust and is easily connectable to a connecting terminal or the like. With windings made of thin wire, there is, therefore, no danger of the start of the winding breaking off when it is connected to a connecting terminal or the like. The same applies to the wire end. The electrically conductive casing of the casting compound prevents corona discharges when the coil is used in a high-voltage transformer.

Figure 1:
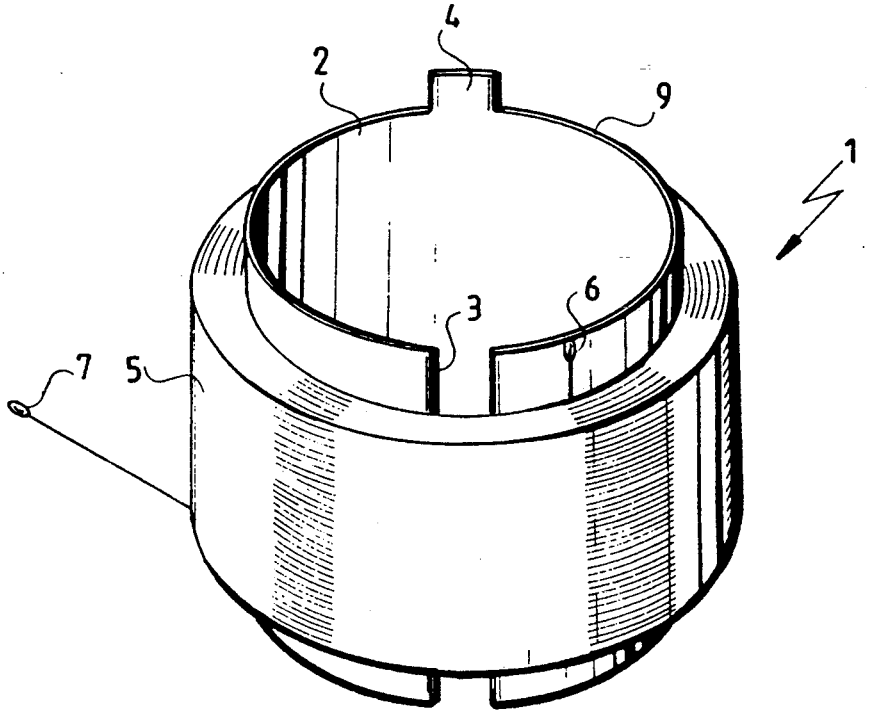

The following description of a preferred embodiment serves in conjunction with the appended drawings to explain the invention in further detail. The drawings show:

FIG. 1 a coil for a transformer; and

Figure 2:
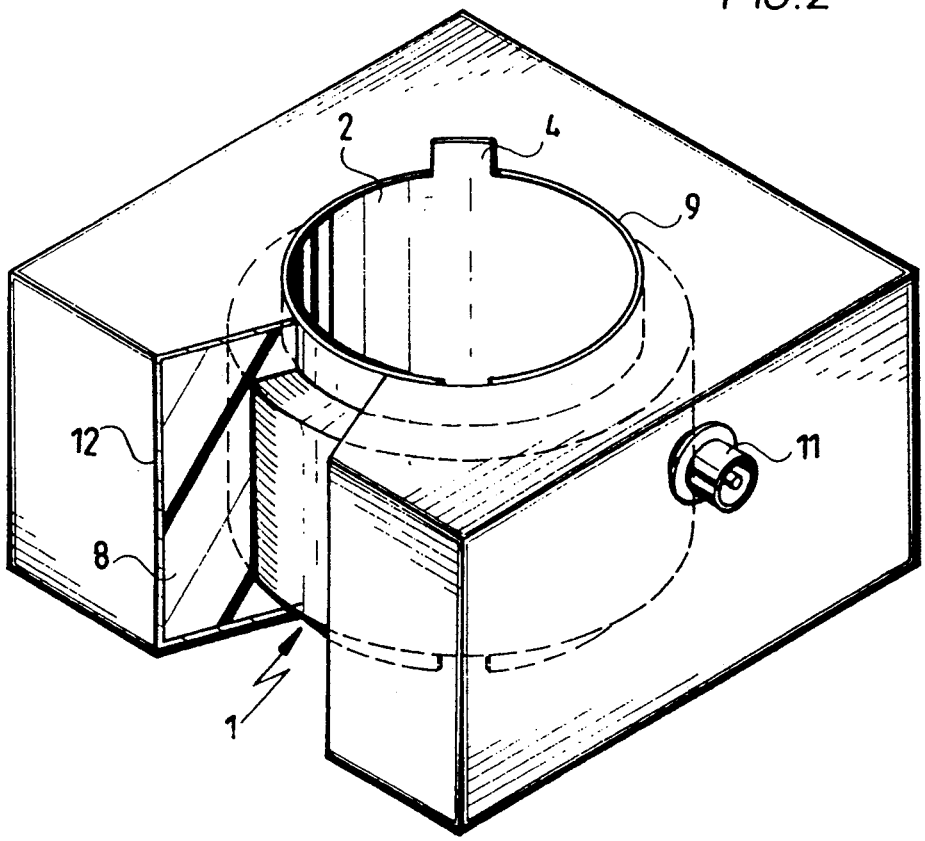

FIG. 2 the coil of FIG. 1 embedded in a casting compound.

The coil illustrated in FIG. 1 is intended for a transformer, in particular a high-voltage transformer. It is wound from relatively thin wire having, for example, a diameter of approximately 0.5 mm. The wire is enamel-insulated and provided with a thermoplastic sheath so that the sheaths of adjacent windings can become "bonded" to one another in a manner known per se when heat is applied, in order to impart more internal stability to the winding as a whole.

As illustrated, the coil 1 comprises an inner winding body in the form of a circular-cylindrical sleeve 2 with a continuous slit 3 extending axially. The sleeve 2 consists of a non-magnetic metal, preferably . . . consists of a non-magnetic metal, preferably copper, silver or an alloy of these metals. The slit 3 prevents the occurrence of eddy currents in the manufactured coil. After completion of the coil, the winding body 2 can be pushed in a known manner onto the core part of a transformer. A projection 4 protrudes integrally from a rim of the sleeve 2.

A wire winding 5 with a winding start 6 and a winding end 7 is arranged on the winding body formed by the sleeve 2. The winding start 6 is electrically conductively connected to the metallic sleeve 7, for example, by soldering before commencement of the winding. This connecting procedure can be easily carried out in such a way that the winding start 6 does not break off. If the winding start should break off, the connecting procedure can be easily repeated. As illustrated, the sleeve 2 protrudes in the region of its rims on both sides beyond the wire winding 5.

The sleeve 2 provided with the wire winding 5 is then inserted in a known manner in a cubic or block-shaped casting mold and a casting compound 8, for example, an epoxy or polyurethane resin is cast around it. When the coil 1 is inserted in the casting mold (not illustrated) the sleeve 2 rests with its bottom rim on the bottom of the mold and hence holds the wire winding 5 at a distance from the bottom so that the poured-in casting compound also encloses the wire winding 5 at its lower end face, and, finally, the winding 5 is embedded all around in the casting compound 8 in the manner shown in FIG. 2. When the coil 1 is completely embedded in the casting compound 8, the upper and lower rims of the sleeve 2 are exposed. In the given circumstances, at least one of the sleeve rims, for example, the upper sleeve rim 9 may also protrude slightly above the body of the casting compound 8. The exposed or protruding rim of the sleeve 2 ensures good conduction of the heat which develops during operation of the coil.

Before the casting compound is poured into the casting mold, the wire end 7 is connected to a connecting terminal, for example, a socket 11 which is anchored in the desired position on the casting mold. After removal of the body formed by the casting compound 8 from the casting mold, the socket 11 is firmly connected to this body (cf. FIG. 2).

A further connecting terminal can be attached in a known manner to the projection 4 of the sleeve 2 protruding upwards above the casting compound 8 without damaging the wire start 6. A connecting wire can also be directly soldered to the projection 4.

As shown in FIG. 2, the outside of the body formed by the casting compound 8 can be provided with an electrically conductive casing 12 made, for example, of metal or an electrically conductive plastics material. To avoid corona discharges, as may occur with high-voltage transformers, the casing 12 is electrically conductively connected to the sleeve 2, which is easily implemented by the casing 12 being brought into direct contact with the coil 2, as shown in FIG. 2.

As stated previously, a thin wire with a bondable, thermoplastic sheath is used to make the wire winding 5 on the sleeve 2. The thickness of the wire may lie between 0.1 and 0.01 mm. To produce the wire winding, the winding body formed by the slit sleeve 2 is attached in a known manner to a rotatingly driven winding tool. The winding start 6 is connected, for example, by soldering, electrically conductively to the sleeve 2, and the winding tool is then made to rotate so that the wire winding is formed by the incoming wire being correspondingly guided on the sleeve 2. The wire winding 5 is formed under the application of heat so that the individual wire windings are bonded together in a known manner and produce a stable unit. Finally, the sleeve 2 provided with the wire winding 5 is embedded in the casting compound 8 in the manner described hereinabove.

I claim:

1. A method for manufacturing a coil for a transformer, in particular a high-voltage transformer, comprising the steps of:

directly electrically conductively connecting the start (6) of a wire with a bondable thermoplastic sheath to a sleeve (2) made of electronically conductive non-magnetic metal and slit axially throughout its length, attaching said sleeve to a rotating winding tool to form an essentially cylindrical wire winding directly on said sleeve with the end faces of said sleeve extending beyond said winding, applying heat to said winding to bond the individual turns of the winding to each other, placing one end face of said sleeve carrying said winding on the bottom of a casting mold to hold the wire winding (5) at a distance from the bottom, connecting the end (7) of said wire remote from said start to a connecting terminal (11), introducing a casting compound (8) into said mold to also enclose the wire winding (5) at its lower end face and to anchor said connecting terminal in said casting compound, providing the outside of said casting compound with an electrically conductive casing (12), electrically conductively connecting said casing to said sleeve and attaching a connection wire directly to the sleeve (2) which is connected to the start (6) of said wire.

* * * * *